US005967257A

United States Patent [19]

Begin et al.

[11] Patent Number: 5,967,257

[45] Date of Patent: Oct. 19, 1999

[54] FOLDING ESCAPE/RESCUE LADDER

[76] Inventors: Raymond O. Begin, 3235 Wishart Road, Victoria, B.C., Canada, V9C 3G3; Leo Twordik, 4195 Metchosin Road, Victoria, B.C., Canada, V9C 3Z5

[21] Appl. No.: 09/078,426

[22] Filed: May 13, 1998

[51] Int. Cl.[6] ..... E04G 3/00

[52] U.S. Cl. ..... 182/96; 182/98; 182/159

[58] Field of Search ..... 182/96, 159, 160

[56] References Cited

U.S. PATENT DOCUMENTS

| | | |
|---|---|---|
| 295,127 | 3/1884 | Miller . |
| 719,990 | 2/1903 | Bracklo . |
| 2,957,539 | 10/1960 | Padlo . |
| 3,024,864 | 3/1962 | Padlo . |
| 3,414,081 | 12/1968 | Wedvik . |
| 3,575,263 | 4/1971 | Reinhard . |
| 3,756,347 | 9/1973 | Messera et al. . |
| 4,037,686 | 7/1977 | Shull . |
| 4,189,028 | 2/1980 | Reinhard . |
| 4,243,119 | 1/1981 | Rossey, Sr. . |
| 4,245,717 | 1/1981 | Soucy . |
| 4,425,983 | 1/1984 | Reinhard . |
| 4,463,829 | 8/1984 | Grin . |
| 4,678,060 | 7/1987 | Pugliese . |
| 4,702,347 | 10/1987 | Nilsen . |
| 4,805,736 | 2/1989 | Byrnes, Jr. . |
| 5,339,920 | 8/1994 | Eriksson . |

*Primary Examiner*—Daniel P. Stodola
*Assistant Examiner*—Hugh B. Thompson
*Attorney, Agent, or Firm*—Jeffrey T. Daines; Barrigar & Moss

[57] ABSTRACT

An escape/rescue ladder that can be mounted in a non-useable condition on the side of a building and can be placed in a useable condition to allow persons to enter and exit from any of a plurality of vertically spaced openings in the building located alongside the ladder. The ladder includes rungs pivotally connected to the building, a rail pivotally connected to the rungs, and a bar extending and constrained to move in the vertical direction adjacent to the building. The bar is connected to the building by at least one counterbalance spring and to at least one rung by a cable fixedly attached to the bar so that as the bar is moved the rungs pivot from their non-useable positions into their useable positions. The springs are selected to approximately counterbalance the weight of the rungs and rail throughout their movement from the non-useable condition to the useable condition. Rest brackets are provided above and below the inner end of each rung so as to support the rung from both directions when the rung has pivoted from a non-useable position at an acute angle with the side of the building into a generally horizontal useable position. Support is provided to the rung by the bracket below at a location further from the side of the building than the inner pivotal axis of the rung and above at a location closer to the side of the building than the inner pivotal axis of the rung.

20 Claims, 9 Drawing Sheets

FOLDING ESCAPE/RESCUE LADDER

FIELD OF THE INVENTION

This invention relates to the field of escape/rescue ladders and in particular to escape/rescue ladders for multistoried buildings that fold against the building when not in use.

BACKGROUND OF THE INVENTION

Folding escape ladders for multistoried buildings have been known for many years. Typically, folding escape ladders are comprised of a fixed rail attached to the side of the building and a movable rail attached to the fixed rail by a plurality of spaced rungs, the rungs pivotally attached so that the ladder can be folded up against the building. However, to be of practical use, particularly for buildings of more than a few storeys, designs for folding ladders need to provide a release mechanism to deploy the movable rail so that the rungs become horizontal and the ladder useable. The release mechanism should be operable from any floor and should deploy the entire ladder. Further, some means must be provided to prevent the movable rail from continuing to move downward after the rungs become horizontal so that once the rungs become horizontal, the ladder provides a firm and stable means of escape. The ladder should not depend upon the ground or some other surface for support (which could shift or give way), but should be self-supporting, relying only upon the building wall for support. Further, for large buildings it is essential that an escape ladder be capable of distributing weight over the entire ladder structure so as not to risk failure of the ladder by concentrating the weight in any particular portion of the structure.

One of the first folding escape ladders is Miller, U.S. Pat. No. 295,127 (Mar. 11, 1884), in which the release mechanism is a cable actuated by a lockable lever near the ground and the lower end of the movable rail rests upon the ground when the ladder is deployed. Disadvantages of the Miller, U.S. Pat. No. 295,127, design are that only someone at ground level with a key may deploy the ladder and that as the rungs are not individually secured against pivoting beyond a horizontal position, the ladder may be somewhat rickety.

Bracklo, U.S. Pat. No. 719,990 (Feb. 10, 1903) appears to improve upon the ladder disclosed in Miller, U.S. Pat. No. 295,127, by providing for release by a cord that may be cut at any window and by increasing rigidity by providing the rungs d with cam-heads $d^2$. Each rung d appears to support itself when the ladder is deployed as each cam-head $d^2$ presses against the side of a building. Disadvantages of the Bracklo, U.S. Pat. No. 719,990, design are (1) that an unauthorized person at ground level could apparently deploy the ladder by cutting the cord and (2) as the ladder as a whole is held by the cord, the release of the ladder would take place with considerable force as no means is provided to slow the fall of the ladder into deployed position, possibly damaging the ladder or injuring bystanders.

Padlo, U.S. Pat. No. 2,957,539 (Oct. 25, 1960) discloses a folding escape ladder for small size building having release mechanisms (FIG. 5) inside the building for releasing the ladder. A hydraulic cylinder 45 is provided to slow the release of the ladder 10. The lower end 18 of the movable rail 12 rests upon the ground G when the ladder 10 is deployed. A side brace 50 shown in FIG. 3 is provided to stabilize the ladder 10.

Padlo, U.S. Pat. No. 3,024,864 (Mar. 13, 1962) discloses a folding ladder in which the rungs nest inside each other.

Wedvik, U.S. Pat. No. 3,414,081 (Dec. 3, 1968) discloses a contractible ladder apparently suitable for a two storey building that does not need support from the ground when deployed. Instead, stops 30 on the ends of the rungs 18 provide stiffening of the ladder by bearing against the legs 10, 12 when the ladder is deployed. A single lever 38 deploys the ladder.

Reinhard, U.S. Pat. No. 3,575,263 (Apr. 20, 1971) discloses a folding fire escape ladder. Each rung 21 is stiffened by stop rivets 34 and 38.

Messera et al., U.S. Pat. No. 3,756,347 (Sep. 4, 1973) discloses an emergency escape ladder. A lifting bar 52 is used to deploy the ladder by lifting hook 58 out of hole 62. The lifting bar 52 and flange 30 are each provided with cam wedges 76 and 78, respectively, which urge the lower end of the moveable subassembly 14 away from the stationary sub-assembly 12 when the lifting bar 52 is raised. If the moveable subassembly 14 does not rest upon the ground or some other surface when the ladder is deployed, then it appears that the moveable subassembly 14 is restrained from movement beyond the desired deployed position entirely by the bottom rung 24 bearing against notch 80.

Shull, U.S. Pat. No. 4,037,686 (Jul. 26, 1977) discloses an escape ladder formed of channel-shaped pieces, the cross-members 45 folding inside of and hinged to the side pieces 15, 16 so that the ends of the cross-members 45 abut the insides of the side pieces 15, 16 in deployed position.

Reinhard, U.S. Pat. No. 4,189,028 (Feb. 19, 1980) discloses a folding fire escape ladder generally similar to Reinhard, U.S. Pat. No. 3,575,263. Stop pins 27, 33 are provided to limit movement of the rungs 16.

Rossey, Sr., U.S. Pat. No. 4,243,119 (Jan. 6, 1981) discloses a folding building side mounted fire ladder having an articulated brace 40 between the upper ends of the side rails 26, 28. No means are provided to stiffen the individual rungs 30.

Reinhard, U.S. Pat. No. 4,425,983 (Jan. 17, 1984) discloses a folding fire escape ladder generally similar to Reinhard, U.S. Pat. No. 4,189,028 (Feb. 19, 1980) and Reinhard, U.S. Pat. No. 3,575,263.

Grin, U.S. Pat. No. 4,463,829 (Aug. 7, 1984) discloses a portable foldable ladder. A locking mechanism (FIGS. 6–8) stabilizes the ladder when in an open mode as latch 62 engages catch plate 72.

Pugliese, U.S. Pat. No. 4,678,060 (Jul. 7, 1987) discloses a collapsible ladder device. Rungs 20 are restrained from swinging past their horizontal positions as the ladder is deployed by the expedient of mounting bracket members 22–28, which are located at the ends of the rungs 20 on pins 29 that are located off-center so that brackets 22–28 engage the bottom wall of the channels 16, 18, limiting the rotational motion of the brackets.

Nilsen, U.S. Pat. No. 4,702,347 (Oct. 27, 1987) discloses a folding fire escape ladder with separate release stations and safety belts with locking brackets. The ladder disclosed is composed of sections that link together to form an escape ladder for a multi-floor building. As each section is deployed, the sections below (but not above) are also deployed.

Soucy, U.S. Pat. No. 4,245,717 (Jan. 20, 1981) discloses a fire escape ladder having support braces, one end of which pivots from the inner end of one rung and the other end of which slides along the rung above as the ladder is opened.

Byrnes, Jr., U.S. Pat. No. 4,805,736 (Feb. 21, 1989) discloses a disappearing ladder the opening of which is actuated by a rod which rotates the rungs of the ladder about their longitudinal axes. Eriksson, U.S. Pat. No. 5,339,920

(Aug. 23, 1994) discloses a foldable fire-escape ladder. Each rung pivots on axes that are centered off the center line of the rung, thereby apparently improving the stability of the ladder.

Of the ladders disclosed in the patents discussed above none seem suitable for multistoried buildings of more than a few storeys.

SUMMARY OF THE INVENTION

The present invention is directed in one aspect to providing an escape/rescue ladder that can be mounted in a non-useable position on the side of a building and can be placed into a useable condition allowing persons to enter and exit from any of a plurality of vertically spaced openings in the building located alongside the ladder. The ladder has a mounting plate extended in a longitudinal direction and adapted to be fixedly secured to the side of the building in a vertical orientation. The mounting plate has a length sufficient to extend between at least two of the openings in the building. A plurality of vertically spaced rungs is provided with each rung pivotally connected near the inner end thereof to the mounting plate so as to pivot about a horizontal axis parallel to the side of the building. A rail extends in the longitudinal direction and parallel to the mounting plate. Each of the rungs is pivotally connected near the outer end thereof to the rail. A bar that extends and is constrained to move in the longitudinal direction parallel and adjacent to the mounting plate is connected to the mounting plate by at least one counterbalance spring and is connected to at least one rung by a cable fixedly attached to the bar so that as the bar is moved the rungs pivot from their non-useable positions into their useable positions. The springs are selected so as to approximately counterbalance the weight of the rungs and rail throughout the movement of the rungs from their non-useable positions to their useable positions. An actuation apparatus is connected to the bar so that the bar may be moved vertically by persons inside the building, by rescue workers outside, or automatically by the building's fire alarm system. The actuation apparatus may be a plurality of handles each of which is accessible from a discrete opening in the building, each handle connected to the bar so that the bar may be moved by any one of the handles, thereby pivoting all of the rungs into useable position. Each handle may be pivotally connected to the mounting plate and a second end connected to the bar by a linkage member pivotally connected to the bar and pivotally connected to the handle near the second end of the handle, thereby to decrease the effort required to move the bar downward. In addition or alternatively, the actuation apparatus may be actuated by a fire alarm system in the building.

Optionally, a plurality of rest brackets, each of which is fixedly attached to the mounting plate below a discrete rung is provided so as to support the rung above from below when the rung above has pivoted from a non-useable position at an acute angle with the side of the building into a generally horizontal useable position. The support is provided to the rung by the bracket at a location further from the side of the building than the inner pivotal axis. Further, each rest bracket, when the rungs are in the useable position, contacts the upper surface of the rung below at a location closer to the side of the building than the inner pivotal axis of the rung so as to resist pivoting of the rung below the horizontal yet allow the rung to pivot into a closed position at an acute angle with the vertical.

Optionally, the ladder may be comprised of at least two segments, each segment comprised of a section of the ladder having at least one spring, at least one handle, and the section of the bar connected to the spring and handle of the segment. Each segment may then be connected to at least one other segment by connection together of an end of the section of the bar of one segment and an end of the section of the bar of other segment.

The present invention is directed in another aspect to providing an escape/rescue ladder segment that can be mounted in a non-useable position on the side of a building together with other such segments to form an escape/rescue ladder that can placed into a useable condition to allow persons to enter and exit from any of a plurality of vertically spaced openings in the building located alongside the ladder. The ladder segment has a mounting plate extended in a longitudinal direction and adapted to be fixedly secured to the side of the building in-a vertical orientation; a plurality of vertically spaced rungs, each rung pivotally connected near the inner end thereof to the mounting plate so as to pivot about a horizontal axis parallel to the side of the building; and a rail extending in the longitudinal direction and parallel to the mounting plate, each of the rungs pivotally connected near the outer end thereof to the rail. A bar is provided which extends and is constrained to move in the longitudinal direction parallel and adjacent to the mounting plate. The bar is connected to the mounting plate by at least one counterbalance spring and connected to at least one rung by a cable fixedly attached to the bar so that as the bar is moved, the rungs pivot from their non-useable positions into their useable positions, and the springs are selected to approximately counterbalance the weight of the rungs and rail throughout the movement of the rungs from their non-useable positions to their useable positions. An actuation apparatus is connected to the bar so that the bar may be moved vertically. The actuation apparatus may be a plurality of handles each of which is accessible from a discrete opening in the building, each handle connected to the bar so that the bar may be moved by any one of the handles, thereby pivoting all of the rungs into useable position. Each handle has a first end pivotally connected to the mounting plate and a second end connected to the bar by a linkage member pivotally connected to the bar and pivotally connected to the handle near the second end of the handle, thereby to decrease the effort required to move the bar downward. In addition, the actuation apparatus may be actuated by a fire alarm system in the building. Connectors are provided for connection together of an end of the bar of the segment to an end of the bar of similar ladder segment so as to form a ladder comprised of a plurality of ladder segments all actuated by the actuation apparatus of any segment.

Optionally, a plurality of rest brackets is provided. Each rest bracket is fixedly attached to the mounting plate below a discrete rung so as to support the rung above from below when the rung above has pivoted from a non-useable position at an acute angle with the side of the building into a generally horizontal useable position, the support provided to the rung by the bracket at a location further from the side of the building than the inner pivotal axis. Further, each rest bracket, when the rungs are in the useable position, contacts the upper surface of the rung below at a location closer to the side of the building than the inner pivotal axis of the rung so as to resist pivoting of the rung below the horizontal yet allow the rung to pivot into a closed position at an acute angle with the vertical.

The present invention is directed in another aspect to providing an escape/rescue ladder mounted in a non-useable position directly to the structure of a building that can be placed into a useable condition to allow persons to enter and exit from any of a plurality of vertically spaced openings in the building located alongside the ladder. The ladder, is comprised of a plurality of vertically spaced rungs, each rung pivotally connected near the inner end thereof to the structure of the building along a vertical line so as to pivot about a horizontal axis parallel to the side of the building. A rail extends in the longitudinal direction and parallel to the rungs, each of the rungs pivotally connected near the outer end thereof to the rail. A bar extends and is constrained to move in the longitudinal direction parallel and adjacent to the rail, and the bar is connected to the structure of the building by at least one counterbalance spring and connected to at least one rung by a cable fixedly attached to the bar so that as the bar is moved the rungs pivot from their non-useable positions into their useable positions. The springs are selected to approximately counterbalance the weight of the rungs and rail throughout the movement of the rungs from their non-useable positions to their useable positions. An actuation apparatus is connected to the bar so that the bar may be moved vertically and the ladder placed in a useable condition. The actuation apparatus may comprise a plurality of handles each of which is accessible from a discrete opening in the building, each handle connected to the bar so that the bar may be moved by any one of the handles, thereby pivoting all of the rungs into useable position. Each handle may have a first end pivotally connected to the mounting plate and a second end connected to the bar by a linkage member pivotally connected to the bar and pivotally connected to the handle near the second end of the handle, thereby decreasing the effort required to move the bar downward. The actuation apparatus may also include means for actuation by a fire alarm system in the building.

Optionally, a plurality of rest brackets may be provided, each rest bracket fixedly attached to the structure of the building below a discrete rung so as to support the rung above from below when the rung above has pivoted from a non-useable position at an acute angle with the side of the building into a generally horizontal useable position, the support provided to the rung by the bracket at a location further from the side of the building than the inner pivotal axis. Each rest bracket, when the rungs are in the useable position, contacts the upper surface of the rung below at a location closer to the side of the building than the inner pivotal axis of the rung so as to resist pivoting of the rung below the horizontal yet allow the rung to pivot into a closed position at an acute angle with the vertical.

DETAILED DESCRIPTION OF THE PREFERRED EMBODIMENT

Figure 1:
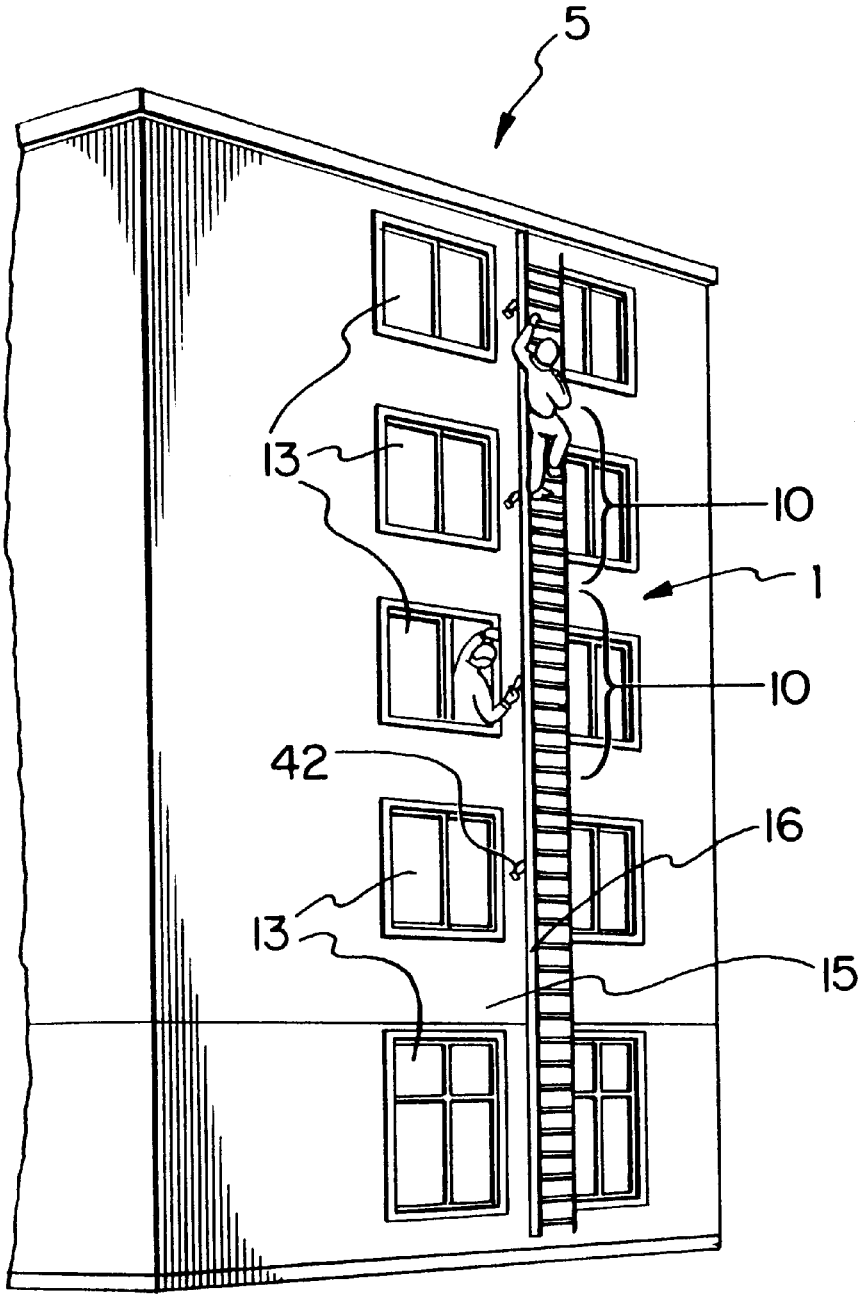
FIG. 1 is a perspective schematic drawing of an escape ladder in accordance with the invention installed upon a multi-story building and deployed in fully open position.
Figure 2:
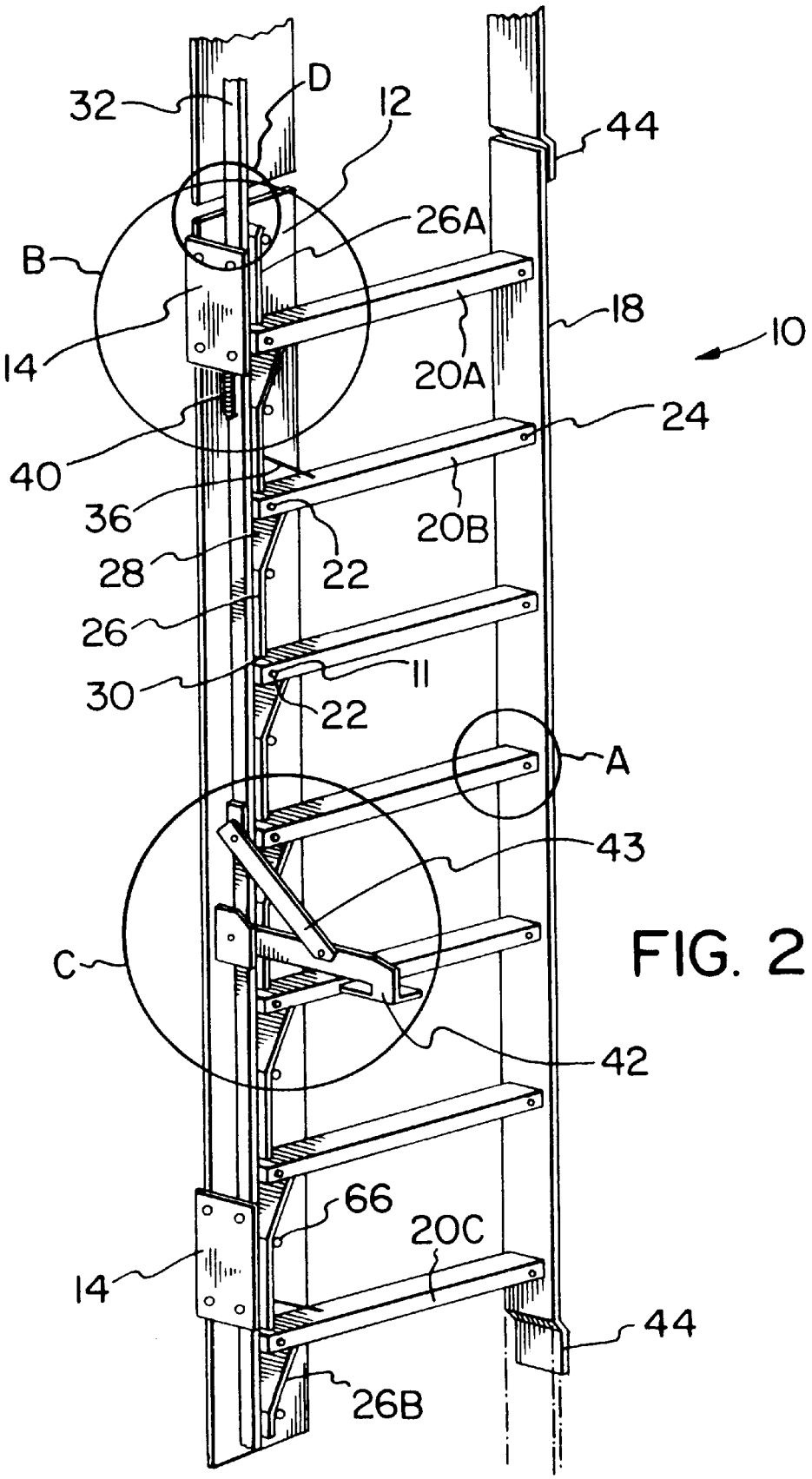
FIG. 2 is a schematic isometric view of the one segment of the escape ladder of FIG. 1.

The preferred embodiment of the invention is comprised of a segmented retractable ladder, each segment generally indicated by reference numeral 10 in FIGS. 1 and 2. As illustrated in FIG. 1, such segments 10 may be mounted end-to-end and attached to a wall 15 of a multistoried building 5 alongside vertically spaced openings, such as windows 13, to form an openable escape ladder, generally indicated by reference numeral 1 in FIG. 1. The ladder segment 10 of FIG. 2 is illustrated in detail in FIGS. 3 through 9. FIGS. 10 through 13 illustrate a segment 10 in closed, partially open and fully open positions. In the following discussion a ladder segment 10 will be described as attached to wall 15, so that all directions are in relation to the wall 15. For example, "inner" or "back" means close to the wall 15 and "outer" or "front" indicates away from the wall 15.

Figure 10:
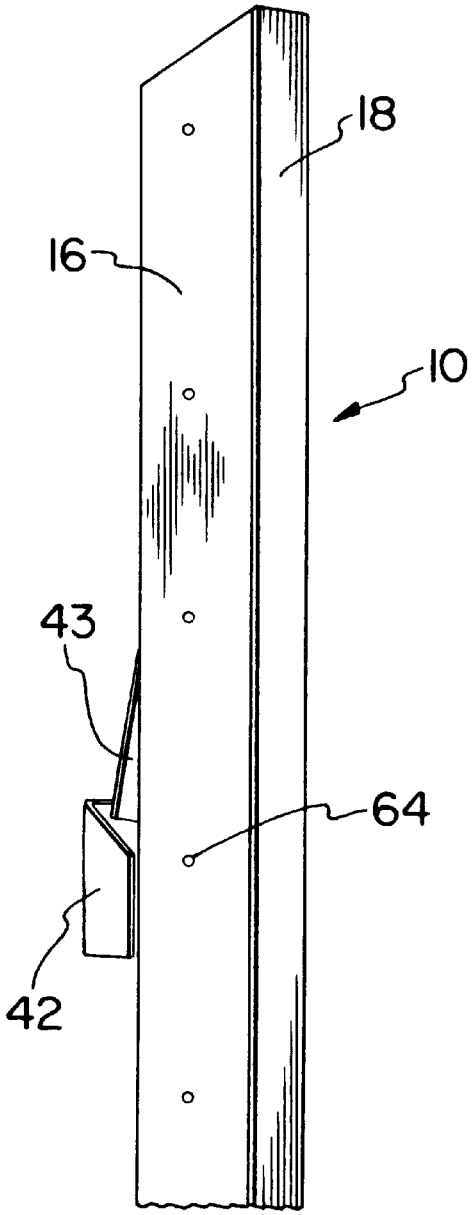
FIG. 10 is a schematic perspective view of the ladder segment of FIG. 2 in closed position with the side cover installed.
Figure 11:
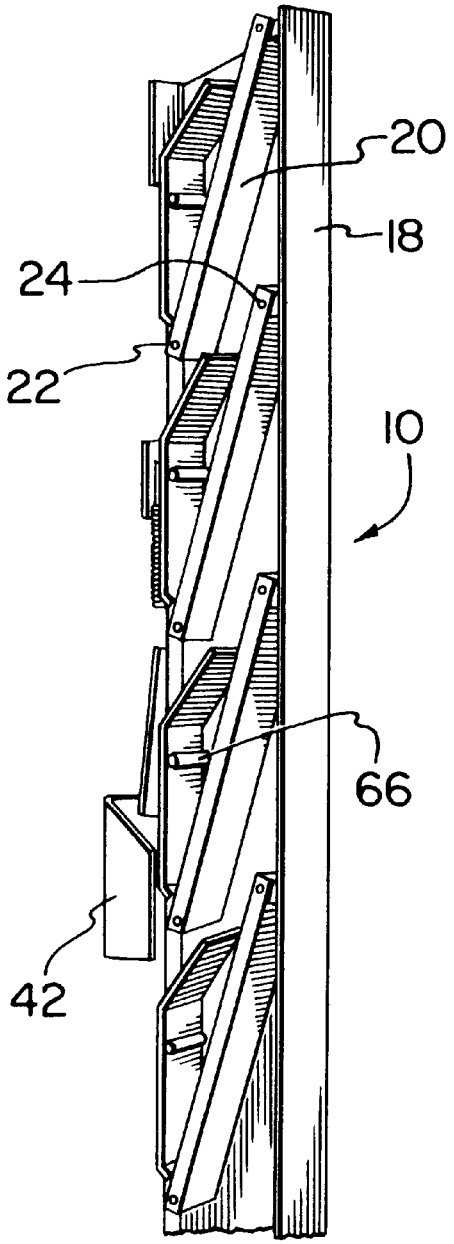
FIG. 11 is a schematic perspective view of the ladder segment of FIG. 2 in closed position with the side cover removed.
Figure 12:
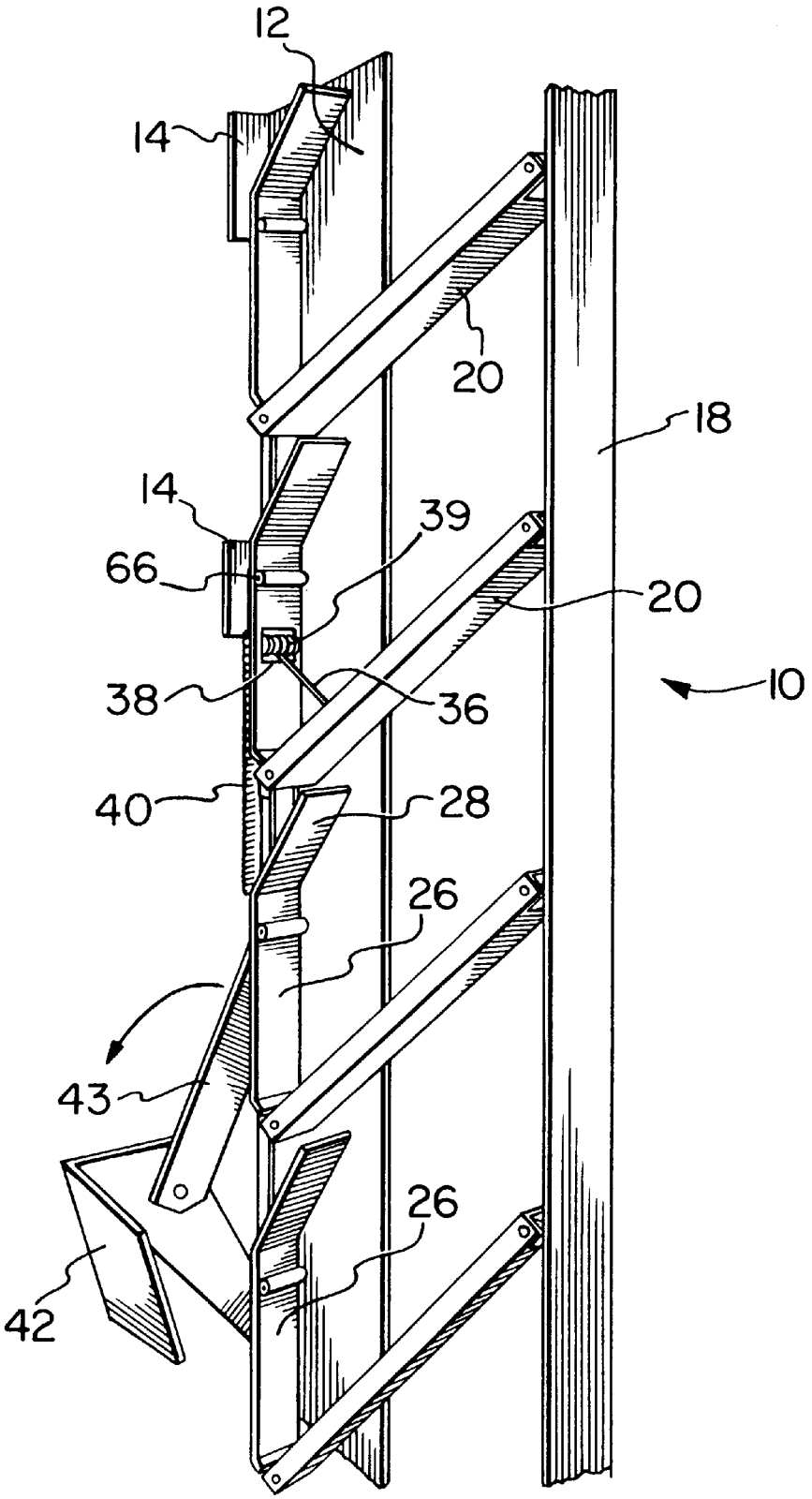
FIG. 12 is a schematic perspective view of the ladder segment of FIG. 2 partially open with the side cover removed.

As shown in FIG. 2, each ladder segment 10 is comprised of a rectangular vertically extended side mounting plate 12 having vertically spaced mounting brackets 14 welded perpendicularly to the long vertical back edge of the mounting plate 12 for bolting or otherwise attaching the mounting plate 12 to the wall 15 when so attached, the mounting plate 12 extends perpendicularly outward from the wall 15 with the mounting brackets 14 flat against the wall 15. Each mounting plate 12 is long enough to extend vertically from a position between one pair of openings 13 to a position between the next pair of openings 13 above. The exemplary ladder segment 10 illustrated in FIG. 2 is provided with seven vertically spaced inner pivot pins 22. Each pin 22 is a 2⅛" by ⅜" rod welded to the mounting plate 12 perpendicularly to the mounting plate 12 at a spacing of 12". Seven hollow 2" wide by 1" high rectangular cross-sectional rungs 20 are further provided, each rung 20 having two horizontally aligned holes 11 approximately ⅜" in diameter whose centers are spaced approximately 1¼" from inner end 17 and two horizontally aligned holes 31 whose centers are spaced approximately ⅝" from outer end 19. Each rung 20 is pivotally mounted on a discrete inner pivot pin 22, the pin 22 sliding through the holes 11 leaving approximately ⅛" of the pin 22 protruding from the rung 20. A rail 18, which also acts as a face plate for the segment 10 when in a closed position as shown in FIG. 10, extends parallel to the mounting plate 12 with its faces perpendicular to the mounting plate 12.

Figure 3:
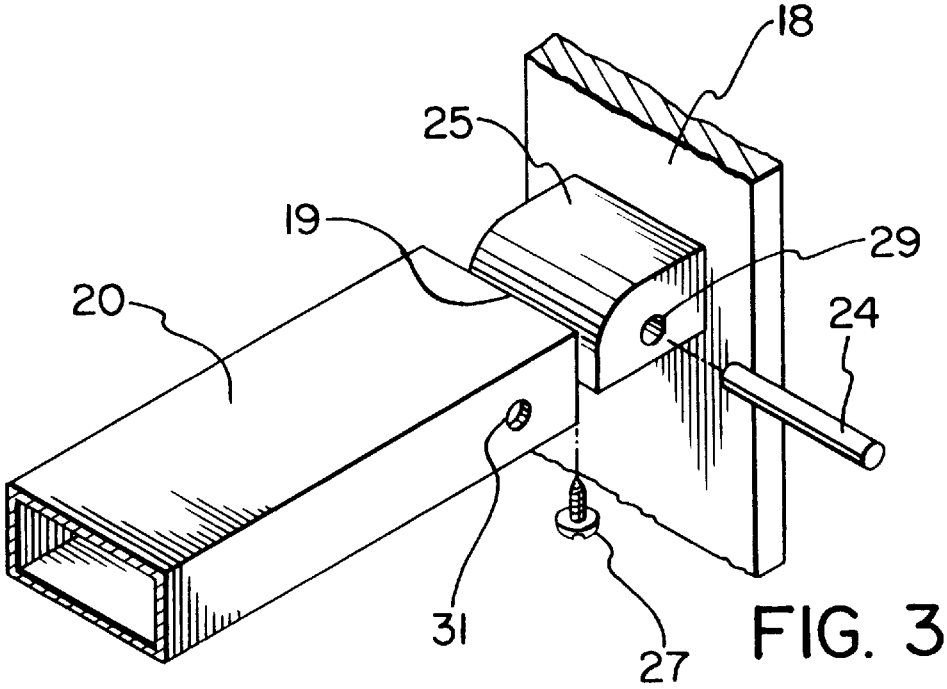
FIG. 3 is a schematic isometric view of the outer pivot mechanism of a rung of the ladder segment of FIG. 2 facing outward from the building (detail A in FIG. 2).
Figure 4:
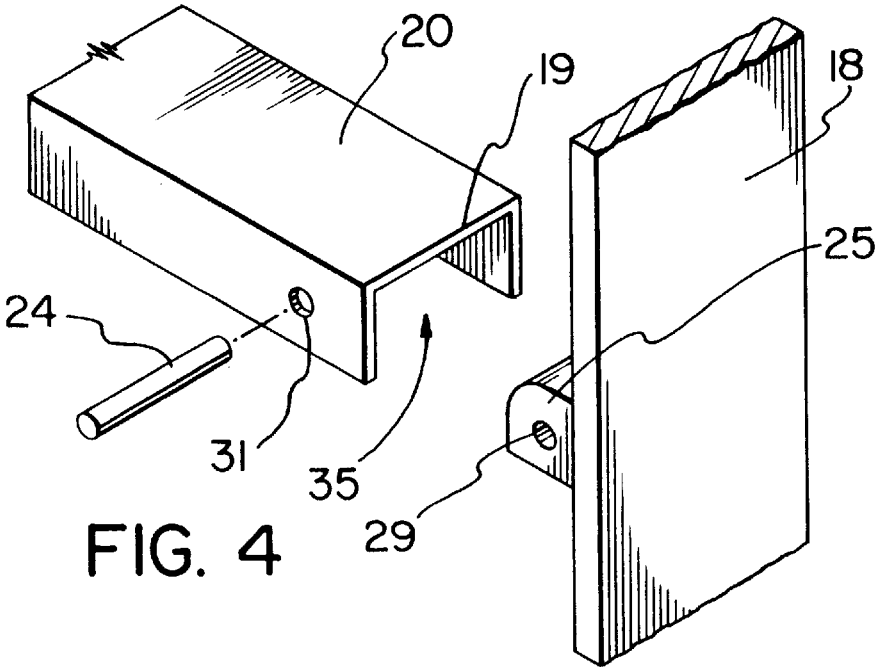
FIG. 4 is another schematic isometric view of the outer pivot mechanism of a rung of the ladder segment of FIG. 2 facing inward toward the building.

The rail 18 is provided with seven stop blocks 25, each as illustrated in detail in FIGS. 3 and 4 (detail A of FIG. 2). Each stop block 25 has cross-sectional dimensions selected to be slidingly received by the hollow outer ends 19 of the rungs 20 and each is welded to the inside face of the rail 18 with the same vertical spacing as the inner pivot pins 22. Each stop block 25 is provided with a horizontal passage 29 for receiving an outer pivot pin 24 and a vertical threaded hole intersecting the passage 29 for receiving a set screw 27. The two horizontally aligned holes 31, one of which is visible in FIGS. 3 and 4, receive an outer pivot pin 24. A clearance cutout 35 is provided in the bottom face of rung 20 extending inward from outer end 19. The rail 18 is pivotally connected to all of the rungs 20 near their outer ends 19 by sliding each stop block 25 through a corresponding outer end 19 of a rung 20, inserting an outer pivot pin 24 through holes 31 and passage 29 and securing the outer pivot pin 24 in position by tightening the set screw 27. The clearance cutouts 35 then allow the rung 20 to pivot about the outer pivot pin 24 in an anti-clockwise rotational direction as viewed in FIGS. 3 and 4, but not in a clockwise rotational direction, thereby restraining the rungs 20 from opening farther than a horizontal position and increasing the strength and rigidity of the ladder segment 10 in its open position.

Figures 6, 7:
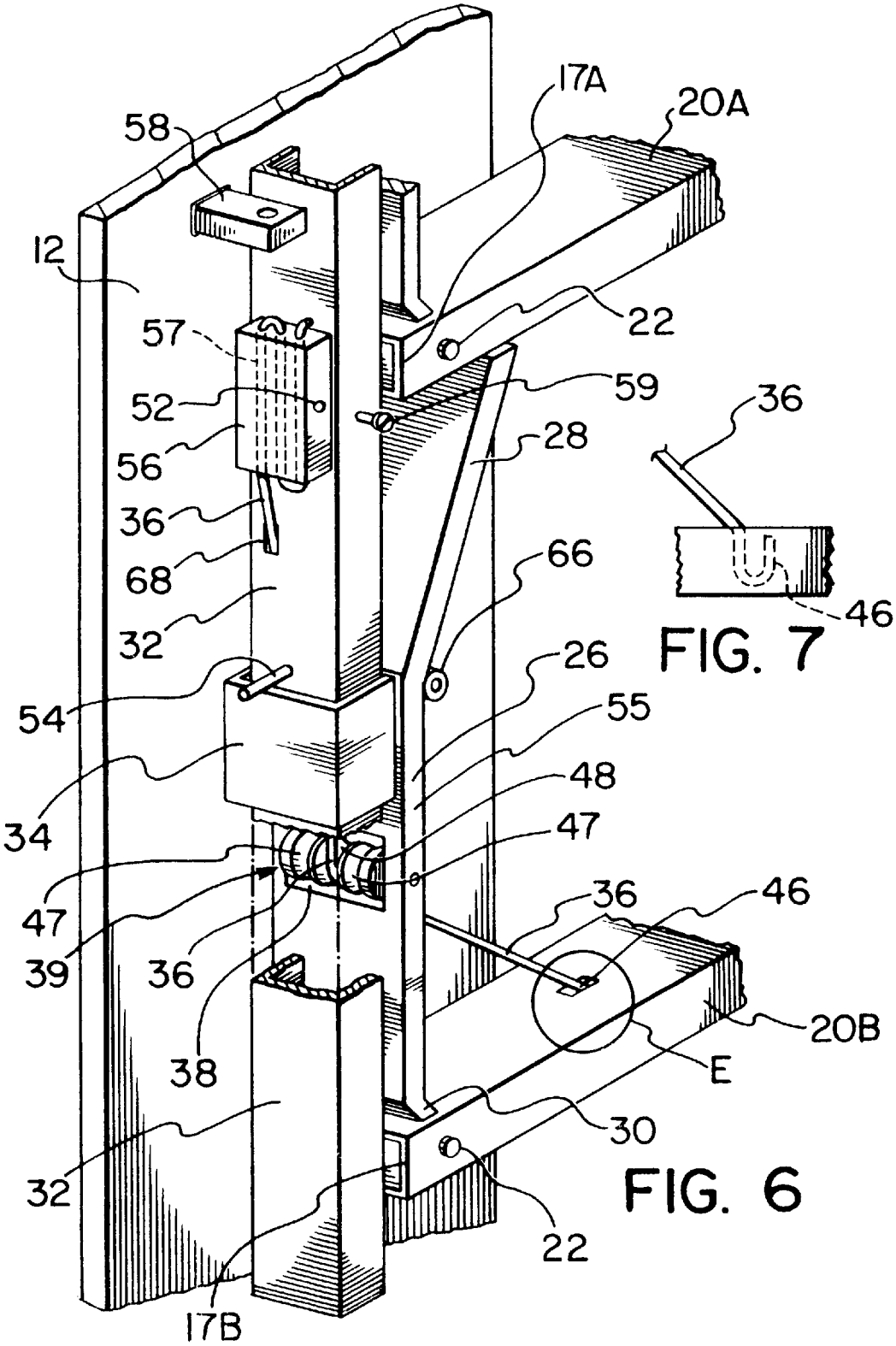
FIG. 6 is a second schematic isometric view of detail B in FIG. 2 showing the cable mechanism omitted in FIG. 5, but with the spring and spring adjustment mechanism removed.
FIG. 7 is a schematic sectional view of the cable-rung attachment of the ladder segment of FIG. 2 (detail E in FIG. 6).
Figure 13:
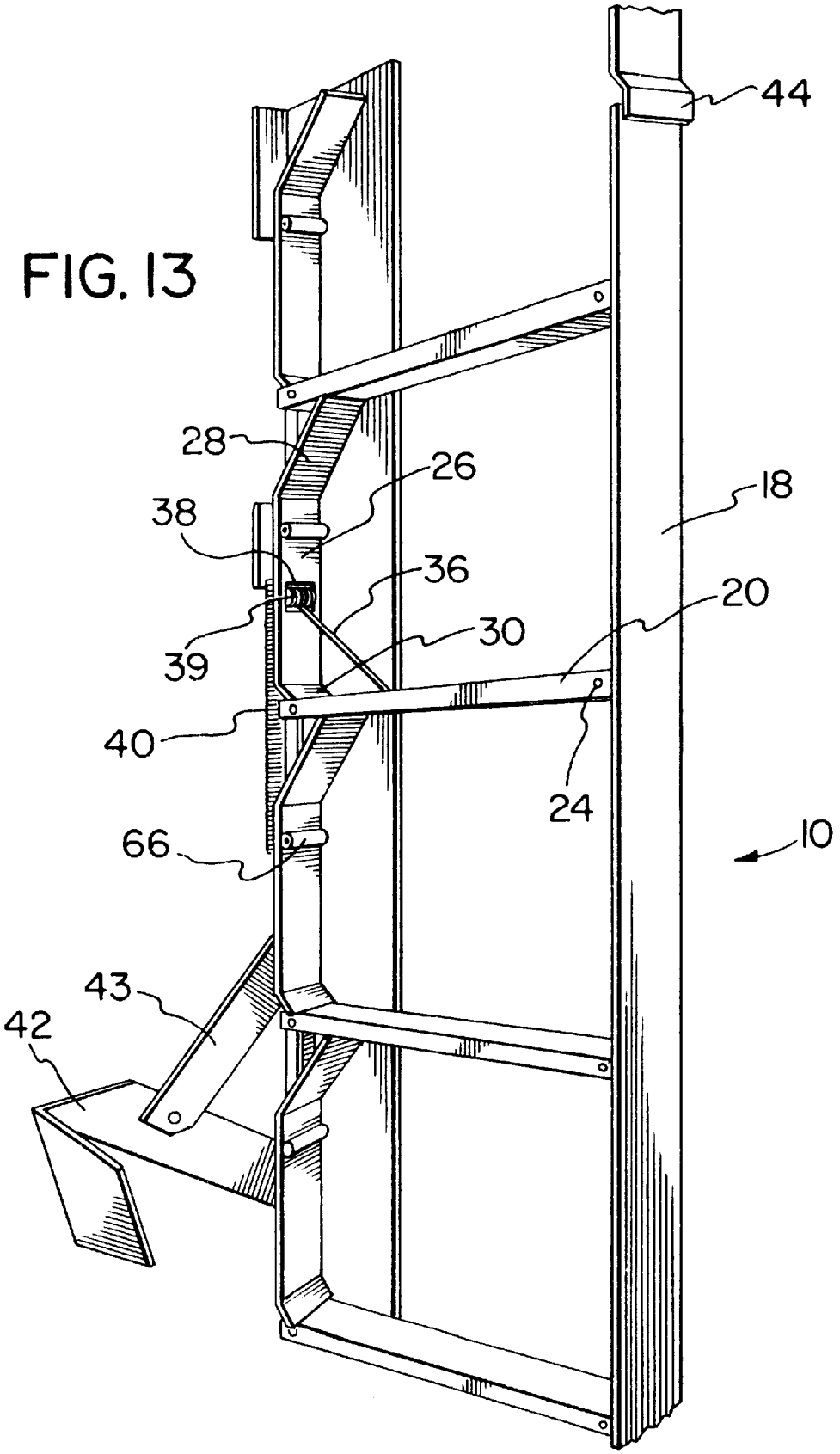
FIG. 13 is a schematic perspective view of the ladder segment of FIG. 2 fully open with the side cover removed.

As illustrated in FIGS. 2 and 6, mounting plate 12 is also provided with six generally vertically aligned rest brackets 26, each welded along generally vertically oriented edges to mounting plate 12 between a discrete pair of inner pivot pins 22. Partial rest brackets 26A and 26B are welded above and below the top and bottom inner pivot pins 22, respectively. Each rest bracket 26 is as wide as the rungs 20 and is formed from a plate of steel bent outward as illustrated in FIG. 6 so as to form a vertical center section 55, an upper portion 28 at an acute outward angle to the vertical, and a lower portion 30 also at an acute outward angle to the vertical. The ends of the upper portion 28 and the lower portion 30 contact the inner end 17A of the rung 20A above and the inner end 17B of the rung 20B below, respectively, when the ladder segment 10 is fully open as illustrated in FIGS. 6 and 13. The upper portion 28 is sufficiently long and bent away from center section 55 at an angle selected so that when the ladder segment 10 is open the end of upper portion 28 contacts rung 20A at a location between the center of the rung 20A and the inner pivot pin 22, thereby providing space for the rung 20A to rotate counter-clockwise about the pin 22 without contacting upper portion 28 until rotated by approximately 60 degrees from the horizontal. To allow such rotation, the lower portion 30 is small enough so that its end contacts rung 20B between the inner pivot pin 22 and the end 17B. This configuration of the rest bracket 26 allows the rungs 20 to rotate into a relatively compact closed position yet provides support from both above and below when the rungs 20 are in horizontal open position.

Figure 5:
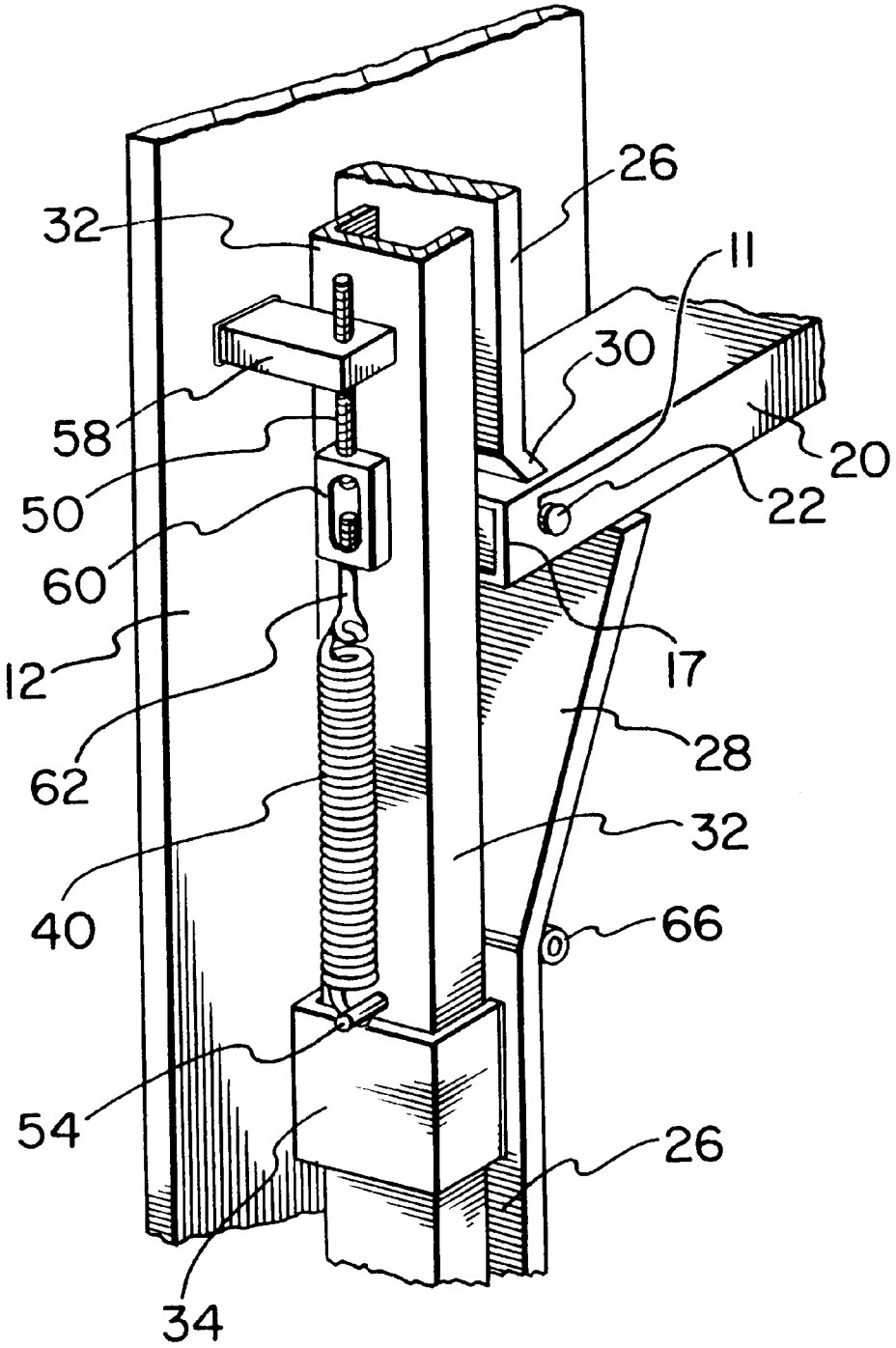
FIG. 5 is a schematic isometric view of the counterbalance spring and spring adjustment mechanism (detail B in FIG. 2) of the ladder segment of FIG. 2 with the segment mounting bracket and cable mechanism omitted.

As illustrated in FIG. 2, a channel bar 32 running parallel to the mounting plate 12 and between the central portions 55 of the rest brackets 26 and mounting brackets 14 is provided to open and close the ladder segment 10. Welded to each central portion 55 just below the top of the central portion 55 is a guide bracket 34 having a U-shaped cross-section opening from top to bottom as best seen in FIGS. 5 and 6. As illustrated in FIGS. 5 and 6, the channel bar 32 slides in guide brackets 34 and is connected at attachment post 54 to a counter-balance spring 40 which in turn is connected to a fixed adjuster block 58 welded to the mounting plate 12 between the path of the channel bar 32 and the wall 15. An adjustable connection between the fixed adjuster block 58 and the counterbalance spring 40 for varying the tension on the spring 40 is provided by a spring adjustment block 60 having two vertically aligned threaded holes, the lower of which holes receives a threaded spring extension 62 attached to the upper end of the spring 40 and the upper of which holes receives a threaded rod 50 threaded into a threaded hole in the fixed adjuster block 58. By turning the threaded rod 50, the tension on the spring 40 may be varied.

The channel bar 32 is connected by cables to the second rung from the top and to the bottom rung in the manner illustrated in FIG. 6. FIG. 6 illustrates a cable 36 connecting the channel bar 32 to rung 20B, the second rung from the top of the ladder segment 10. The connection to the bottom rung 20C is as illustrated in FIG. 6 for connection to rung 20B, except that the attachment post 54 and fixed adjuster block 58 are not present. It should be noted that for clarity, FIG. 5 does not show the connection of the channel bar 32 to the rung below the spring 40. Similarly, the portion of channel bar 32 below guide bracket 34 is omitted in FIG. 6 to show the path of the cable 36.

As illustrated in FIG. 6, the central portion 55 of the rest bracket 26 is provided with a rectangular opening 38 in which is mounted a roller 39 whose axis is perpendicular to the mounting plate 12. The roller 39 has three grooves; a center groove 48 for the cable 36 and two side grooves 47 for the edges of the channel bar 32. One end of the cable 36 is fixed to the rung 20B at a position approximately 4" from the inner pivot pin 22 by a crimp attachment 46 shown in detail in FIG. 7 (detail E). The cable 36 runs from attachment 46, under the roller 39, upward through the interior of channel bar 32, and then out through an opening 68 in the channel bar 32 into an adjustable cable fastener block 56. Adjustable cable fastener block 56 is welded, to the channel bar 32 and is provided with several passages 57 for threading the cable 36 back and forth through the block 56 and a threaded hole 52 intersecting one of the passages 57 for receiving a set screw 59. When the ladder segment 12 is assembled, the cable 36 is adjusted and the adjustment held by threading the cable through the block 56 and then tightening the set screw 59.

Using the spring adjustment block 60, the tension on the counterbalance spring 40 is adjusted so that a minimal effort is required to open and close the ladder segment 10 by raising and lowering the channel bar 32. The spring-tension counterbalances the weight of the rail 18 and rungs 20.

Figure 8:
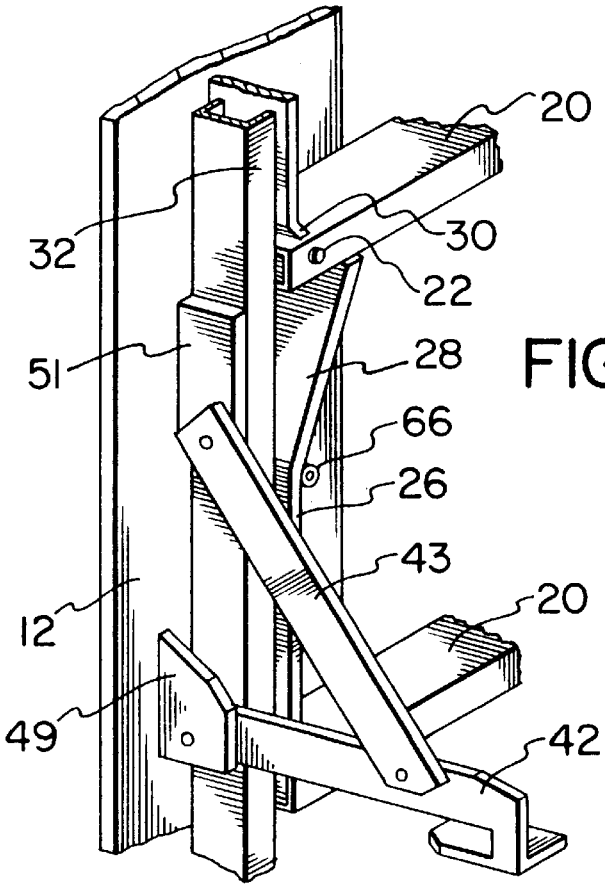
FIG. 8 is a schematic isometric view of the handle of the ladder segment of FIG. 2 (detail C in FIG. 2).

To aid in opening and closing the ladder segment 10, a handle 42 illustrated in FIG. 8 (detail C in FIG. 2) is provided. The handle 42 is pivotally connected to the mounting plate 12 at a pivot block 49, which block 49 is welded to the mounting plate 12. A linkage 43 is pivotally connected to the channel bar 32 by a pivot block 51, which is welded to the channel bar 32, and connects the handle 42 to the channel bar 32. The linkage 43 provides increased leverage over a simple handle affixed directly to the channel bar 32.

Figure 9:
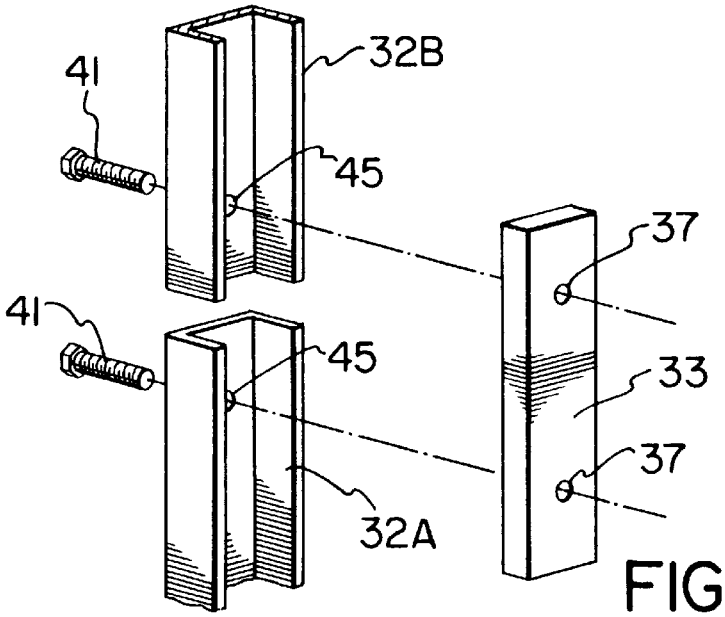
FIG. 9 is a schematic isometric view of the channel bar connector for connecting the ladder segment of FIG. 2 to another such ladder segment above (detail D in FIG. 2).

Two or more ladder segments 10 may be linked together by connecting the top end 32A of the channel bar 32 of one segment to the bottom end 32B of the channel bar 32 of the segment above in the manner illustrated in FIG. 9. Each end of each channel bar 32 is provided with a hole 45 through which a mounting bolt 41 may be passed. A channel connector 33 having two threaded holes 37 for receiving mounting bolts 41 may then be used to connect the channel bars 32A and 32B together.

As illustrated in FIGS. 2 and 13, the lower end of each rail 18 is provided with an offset slip cover 44 to overlap the upper end of the rail 18 of the segment below to prevent dirt from entering the interior of the ladder segment 10 when the segment is closed.

Each ladder segment 10 is also provided with a rectangular removable side access cover 16 having dimensions sufficient to cover the rest brackets 26 and the rungs 20 when the ladder segment 10 is closed. The access cover 16 has been removed in FIG. 2, but is shown installed in FIGS. 1 and 10. As illustrated in FIGS. 2 and 10, welded to the mounting plate 12 are several long nuts or posts 66 with tapped holes for receiving mounting screws 64 for attaching the access cover 16 to the mounting plate 12 parallel to the mounting plate 12. The access cover 16 is also provided with approximately ⅜" diameter by ⅛" deep recesses (not shown) for receiving the protruding ends of the pins 22 when the access cover 16 is installed.

Each ladder segment 10 in a multi-segment escape ladder 1 is only connected to other segments 10 by the connection of the channel bars 32. Each segment 10 self-supporting; no weight is transmitted to other segments 10. The ladder 1 is constructed of ⅜" to ½" iron, thus enabling to each segment to carry loads of over 2000 lbs. Further, opening of any one segment 10 by operation of the handle 42 opens all segments 10 simultaneously and with minimal effort due to the 30 counterbalancing of the rails 18 and rungs 20 by the spring 40. The ladder 1 is intended to be installed so that when opened the bottom rung 20 is approximately 12" from the ground and the lower end of the rail 18 of the lowest segment 10 is not in contact with the ground.

For security reasons, as illustrated in FIG. 1, the lowest segment 10 of the ladder 1 is not provided with a handle 42. However, rescue personal can use ladders to reach the second floor handle 42 or, alternatively, the ladder 1 may be open automatically by the building's fire alarm system.

The ladder 1 may be used for rescuing persons trapped inside the building 5 as well as for allowing persons to escape from the building 5. The ladder 1 may be conveniently installed to blend into the design of the building 5. For example, on a high rise building a retro-fitted ladder 1, when closed, may appear to be a down spout.

In new construction, the ladder 5 may be mounted inside the steel frame of the building 5 so that only the handles would exposed. The mounting plate 12 may then be dispensed with and the pivot pins 22, rest brackets 26, adjuster blocks 58, and pivot blocks 49 attached directly to the frame of the building 5.

Other embodiments will be apparent to those skilled in the art and, therefore, the invention is defined in the claims.

What is claimed is:

1. An escape/rescue ladder mountable on the side of a building having a plurality of vertically spaced openings so as to be movable between a non-useable condition and a useable condition to allow persons to enter and exit from any of the plurality of vertically spaced openings in the building located alongside the ladder, the ladder comprising:

an elongate mounting plate adapted to be fixedly secured to the side of the building in a vertical orientation;

an elongate rail extending parallel to the mounting plate;

a plurality of rungs spaced along the length of the mounting plate, each rung having an inner and an outer end and pivotally connected near the inner end thereof to the mounting plate so that when the mounting plate is secured to the building in a vertical orientation, the rungs each pivot about a discrete inner horizontal pivotal axis parallel to the side of the building and near the outer end thereof to the rail;

a bar extending and constrained to move along an axis parallel and adjacent to the mounting plate, the bar connected to the mounting plate by at least one counterbalance spring and connected to at least one rung by a cable fixedly attached to the bar so that when the mounting plate is secured to the building in a vertical orientation and as the bar is moved each of the rungs pivot from the non-useable condition at an acute angle with the mounting plate into the useable condition at a generally horizontal position and the weight of the rungs and rail together is approximately counterbalanced by the at least one spring throughout the movement of the rungs from the non-useable condition to the useable condition; and an actuation apparatus connected to the bar so that the bar may be moved upwards or downwards when the mounting plate is secured to the building in a vertical orientation.

2. The ladder of claim 1, further comprising a plurality of rest brackets, each rest bracket fixedly attached to the mounting plate so that when the mounting plate is secured to the building in a vertical orientation each rest bracket supports a discrete rung from below when the rung has pivoted from the non-useable condition at an acute angle with the mounting plate into the generally horizontal useable condition, support provided to the rung by the bracket at a location further from the side of the building than the inner pivotal axis of the rung.

3. The ladder of claim 2, wherein each rest bracket, when the mounting plate is secured to the building in a vertical orientation and the rungs are in the useable condition, contacts the upper surface of the rung below at a location closer to the side of the building than the inner pivotal axis of the rung so as to resist pivoting of the rung below the horizontal yet allow the rung to pivot into a closed position at an acute angle with the mounting plate.

4. The ladder of claim 3, wherein the actuation apparatus is connectable to a fire alarm system in the building when the mounting plate is secured to the building so that the actuation apparatus is actuated by the fire alarm system.

5. The ladder of claim 3, wherein the actuation apparatus is a plurality of handles spaced so that each of them is accessible from a discrete one of the vertically spaced openings in the building when the mounting plate is secured to the building in a vertical orientation, each handle connected to the bar so that the bar may be moved by any one of the handles, thereby pivoting all of the rungs into the useable condition.

6. The ladder of claim 5, wherein each handle has a first end pivotally connected to the mounting plate and a second end connected to the bar by a linkage member pivotally connected to the bar and pivotally connected to the handle near the second end of the handle, thereby to decrease the effort required to move the bar downward when the mounting plate is secured to the building in a vertical orientation.

7. The ladder of claim 6, wherein the ladder is comprised of at least two segments, each segment comprised of a section of the ladder having at least one spring, at least one handle, and a section of the bar connected to the at least one spring and handle of the segment, each segment connected to at least one other segment by connection together of an end of the section of the bar with an end of the section of the bar of the other segment.

8. An escape/rescue ladder segment mountable on the side of a building having a plurality of vertically spaced openings together with other such segments to form an escape/rescue ladder that is movable between a non-usable condition and a useable condition to allow persons to enter and exit from any of the plurality of vertically spaced openings in the building located alongside the ladder segment, the ladder segment comprising:

an elongate mounting plate adapted to be fixedly secured to the side of the building in a vertical orientation;

an elongate rail extending parallel to the mounting plate;

a plurality of rungs spaced along the length of the mounting plate, each rung having an inner and an outer end and pivotally connected near the inner end thereof to the mounting plate so that when the mounting plate is secured to a building in a vertical orientation, the rungs each pivot about a discrete inner horizontal pivotal axis parallel to the side of the building and near the outer end thereof to the rail;

a bar extending and constrained to move along an axis parallel and adjacent to the mounting plate, the bar connected to the mounting plate by at least one counterbalance spring and connected to at least one rung by a cable fixedly attached to the bar so that when the mounting plate is secured to the building in a vertical orientation and as the bar is moved each of the rungs pivot from the non-useable condition at an acute angle with the mounting plate into the useable condition at a generally horizontal position and the weight of the rungs and rail together, is approximately counterbalanced by the at least one spring throughout the movement of the rungs from the non-useable condition to the useable condition; and an actuation apparatus connected to the bar so that the bar may be moved upwards or downwards when the mounting plate is secured to the building in a vertical orientation.

9. The ladder segment of claim 8, further comprising a plurality of rest brackets, each rest bracket fixedly attached to the mounting plate below a discrete rung so as to support the rung above from below when the rung above has pivoted from the non-useable condition at an acute angle with the mounting plate into the generally horizontal useable condition, support provided to the rung by the bracket at a location further from the side of the building than the inner pivotal axis.

10. The ladder segment of claim 9, wherein each rest bracket, when the rungs are in the useable condition, contacts the upper surface of the rung below at a location closer to the side of the building than the inner pivotal axis of the rung so as to resist pivoting of the rung below the horizontal yet allow the rung to pivot into a closed position at an acute angle with the mounting plate.

11. The ladder segment of claim 10, wherein the actuation apparatus is connectable to a fire alarm system in the building when the mounting plate is secured to the building so that the actuation apparatus is actuated by the fire alarm system.

12. The ladder segment of claim 10, wherein the actuation apparatus is at least one handle which is accessible from a discrete one of the vertically spaced openings in the building, the at least one handle connected to the bar so that the bar may be moved by the at least one handle, thereby pivoting all of the rungs into the useable condition.

13. The ladder segment of claim 12, wherein each handle has a first end pivotally connected to the mounting plate and a second end connected to the bar by a linkage member pivotally connected to the bar and pivotally connected to the handle near the second end of the handle, thereby to decrease the effort required to move the bar downward.

14. The ladder segment of claim 13, additionally comprising connectors for connection together of an end of the bar of the segment to an end of the bar of similar ladder segment so as to form a ladder comprised of a plurality of ladder segments all actuated by the actuation apparatus of any segment.

15. An escape/rescue ladder attachable to a building having a plurality of vertically spaced openings in a non-useable condition that can be placed in a useable condition to allow persons to enter and exit from any of the plurality of vertically spaced openings in the building located alongside the ladder, the ladder comprising:

a plurality of vertically spaced rungs, each rung having an inner end thereof for pivotal connection to the building along a vertical line so as to pivot about an inner horizontal pivotal axis parallel to the side of the building and an outer end;

an elongate rail extending parallel to the side of the building, each of the rungs pivotally connected near the outer end thereof to the rail;

a bar extending and constrained to move along an axis parallel and adjacent to the rail, the bar connectable to the building by at least one counterbalance spring and connected to at least one rung by a cable fixedly attached to the bar so that when the rungs are connected to the building along a vertical line and as the bar is moved, the rungs pivot from the non-useable condition at an acute angle with the vertical line into the useable condition at a generally horizontal position and the weight of the rungs and rail together, is approximately counterbalanced by the at least one spring throughout the movement of the rungs from the non-useable condition to the useable condition; and an actuation apparatus connected to the bar so that the bar may be moved downwardly to place the ladder in a usable condition.

16. The ladder of claim 15, further comprising a plurality of rest brackets, each rest bracket fixedly attachable to the building below a discrete rung when the rungs are connected to a building along a vertical line so as to support the rung above from below when the rung above has pivoted from the non-useable condition at an acute angle with the side of the building into the generally horizontal useable condition, support provided to the rung by the bracket at a location further from the side of the building than the inner pivotal axis.

17. The ladder of claim 16, wherein each rest bracket, when the rungs are in the useable condition, contacts the upper surface of the rung below at a location closer to the side of the building than the inner pivotal axis of the rung so as to resist pivoting of the rung below the horizontal yet allow the rung to pivot into a closed position at an acute angle with the building.

18. The ladder of claim 17, wherein the actuation apparatus is a plurality of handles each of which is accessible from a discrete one of the vertically spaced openings in the building, each handle connected to the bar so that the bar may be moved by any one of the handles, thereby pivoting all of the rungs into the useable condition.

19. The ladder of claim 18, wherein each handle has a first end pivotally connected to the building and a second end connected to the bar by a linkage member pivotally connected to the bar and pivotally connected to the handle near the second end of the handle, thereby to decrease the effort required to move the bar downward.

20. The ladder of claim 17, wherein the actuation apparatus is connectable to a fire alarm system in the building when the mounting plate is secured to the building when the rungs are connected to the building along a vertical line so that the actuation apparatus is actuated by the fire alarm system.

* * * * *